US007246414B2

(12) United States Patent
Wu

(10) Patent No.: US 7,246,414 B2
(45) Date of Patent: Jul. 24, 2007

(54) SOFT HANDLE (I)

(76) Inventor: Michael Chien-Lung Wu, 12F, No. 24, Chi Lin Road, Taipei (TW)

( * ) Notice: Subject to any disclaimer, the term of this patent is extended or adjusted under 35 U.S.C. 154(b) by 222 days.

(21) Appl. No.: 11/171,440

(22) Filed: Jul. 1, 2005

(65) Prior Publication Data

US 2007/0000094 A1 Jan. 4, 2007

(51) Int. Cl.
*A45C 7/00* (2006.01)
*E05B 1/00* (2006.01)

(52) U.S. Cl. ..... 16/430; 16/431

(58) Field of Classification Search ..... 16/430, 16/431, 436, 421, 422, 426, 429, DIG. 12, 16/DIG. 18, DIG. 19; 74/551.1, 557, 558; 135/25.41, 25.4; 81/177.1, 489, 177.6; 15/143.1, 15/145; 30/323, 326
See application file for complete search history.

(56) References Cited

U.S. PATENT DOCUMENTS 2,205,769 A * 6/1940 Sweetland ..... 81/492
2,239,180 A * 4/1941 Kupfer ..... 135/72
3,269,399 A * 8/1966 Smith ..... 135/72
3,981,043 A * 9/1976 Curry ..... 16/430
5,203,561 A * 4/1993 Lanctot ..... 473/282
5,299,475 A * 4/1994 Stroop ..... 81/489
5,519,918 A * 5/1996 Chang ..... 16/430
5,713,104 A * 2/1998 Giampaolo, Jr. ..... 16/422
6,959,469 B2 * 11/2005 Blauer et al. ..... 16/431
6,968,599 B2 * 11/2005 Blauer et al. ..... 16/431
2001/0052163 A1 * 12/2001 Kelsay et al. ..... 15/235.4
2003/0024543 A1 * 2/2003 Wolf ..... 132/212
2003/0051316 A1 * 3/2003 Willat ..... 16/430

* cited by examiner

*Primary Examiner*—Jack W. Lavinder
*Assistant Examiner*—Andre' L. Jackson
(74) *Attorney, Agent, or Firm*—Rosenberg, Klein & Lee

(57) ABSTRACT

The invention relates to a soft handle, which includes a soft and supports therein. A top cap and a bottom cap are provided to seal the shell, while the inner space of the shell is fulfilled with sticky liquid. The handle will be therefore really soft for facilitating use when connecting other products.

3 Claims, 10 Drawing Sheets

SOFT HANDLE (I)

FIELD OF THE INVENTION

The present invention relates to a soft handle, which includes a soft shell connecting with an inner support. And inner space of the shell is fulfilled with sticky liquid to provide a soft character for handling.

BACKGROUND OF THE INVENTION

There are many products having a handle for facilitating users to hold, such as umbrellas, hair driers, and combs. The traditional handle always has a hard handle with a fixed shape. After a long time using, users feel uncomfortable usually. Although the known handle sometimes has a rubber cover, it is still not comfortable for long time use.

SUMMARY OF THE INVENTION

The present invention is to provide a soft handle, which includes a soft shell connecting with a support and fulfilling with sticky liquid inside to form a really soft handle for comfortable use. Now, accompanying with the following drawings, the character of the present invention will be described here and after.

DETAILED DESCRIPTION OF THE PREFERRED EMBODIMENT

Figure 1:
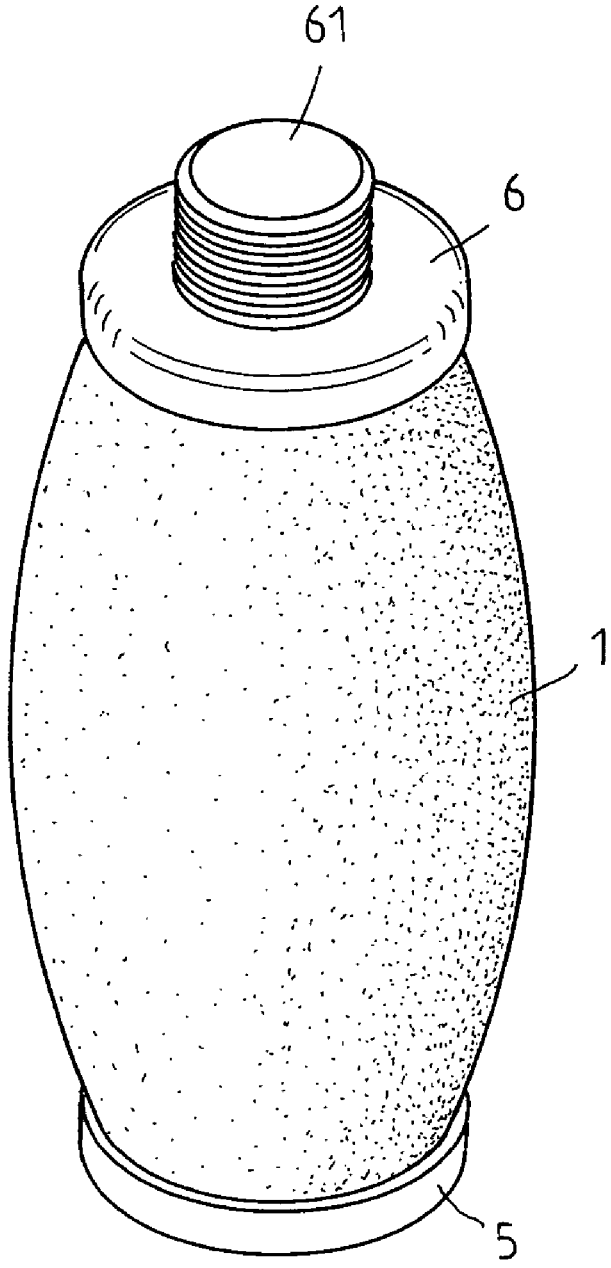
FIG. 1 is a perspective view showing a soft handle according to the present invention.
Figure 2:
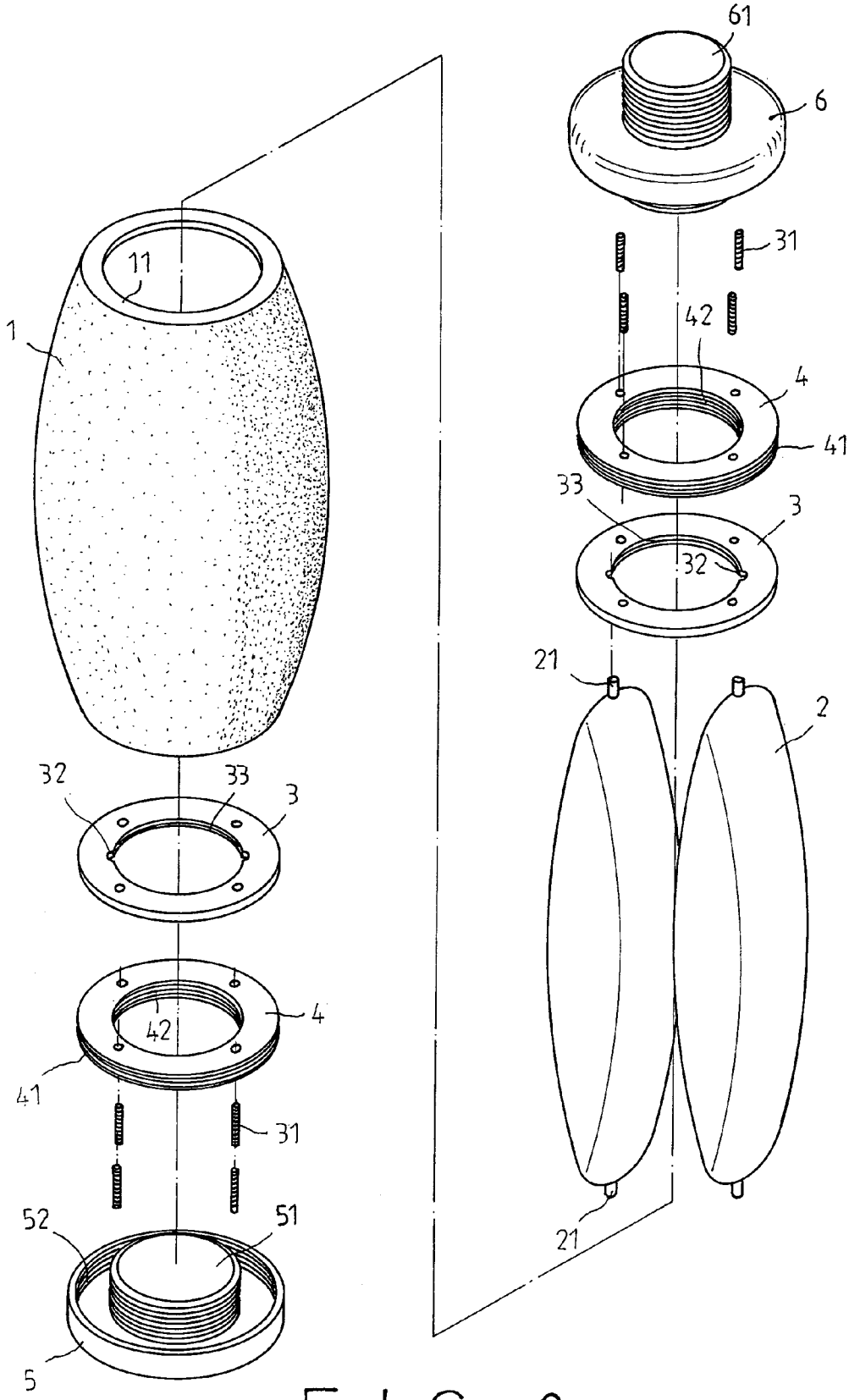
FIG. 2 is an exploded perspective view of FIG. 1.
Figure 4:
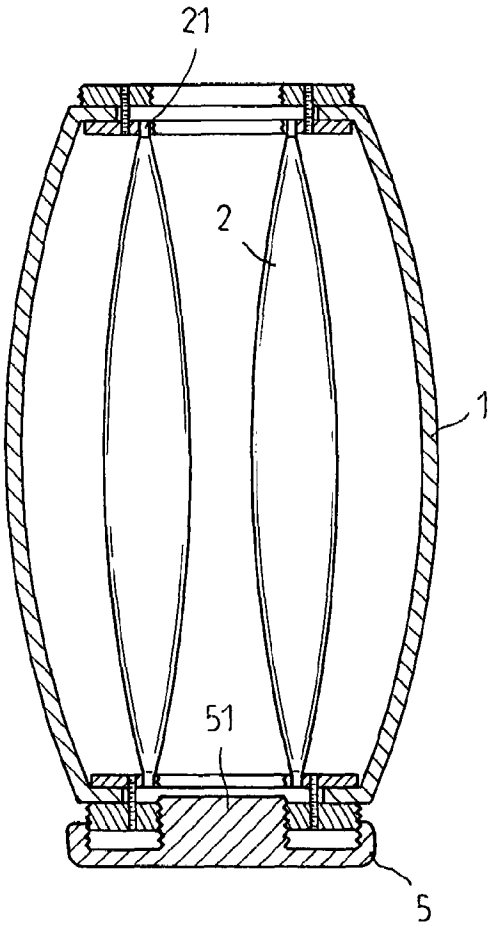
FIGS. 3 to 6 show the cross-sectional views of assembling procedures of FIG. 2.
Figure 3:
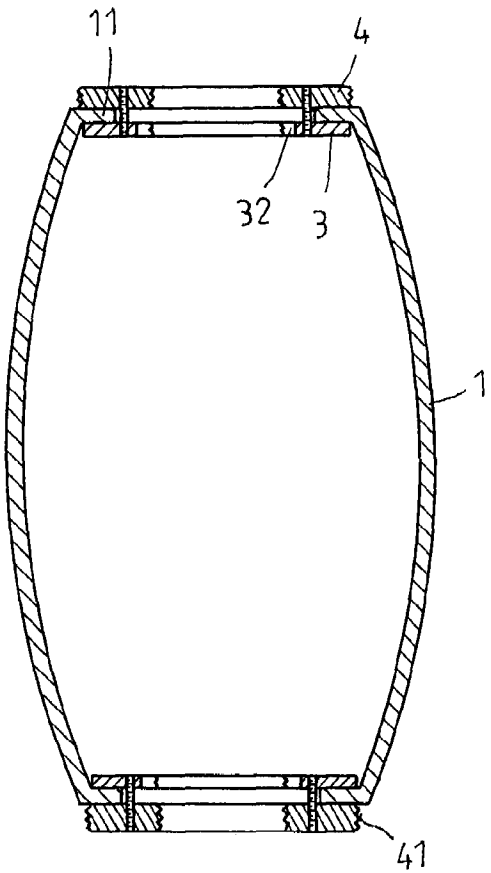

Please refer to FIGS. 1 and 2; the present invention relates to a soft handle, which includes a soft shell (1) and a pair of supports (2). The hollow shell (1) has a flange (11) both top and bottom sides, which is capable of being clipped by an inner ring (3) and an outer ring (4), both of which are engaged by screws (31), as shown in FIG. 3 to become a single body. The inner rings (3) have two inner opposite apertures (32) and the outer rings (4) have outer threads (41), while both inner and outer rings (3), (4) have inner threads (33), (42). The two supports (2) have top and bottom rods (21) to engage with related apertures (32) of the inner rings (3) to provide securement. A bottom cap (5) connects with a bottom side of the shell (1), wherein the bottom cap (5) has a thread rod (51) to connect with inner threads (33), (42) of the rings (3), (4) and has inner threads (52) formed in its side flange to connect with outer threads (41) of the outer ring (4), as shown in FIG. 4.

Figure 6:
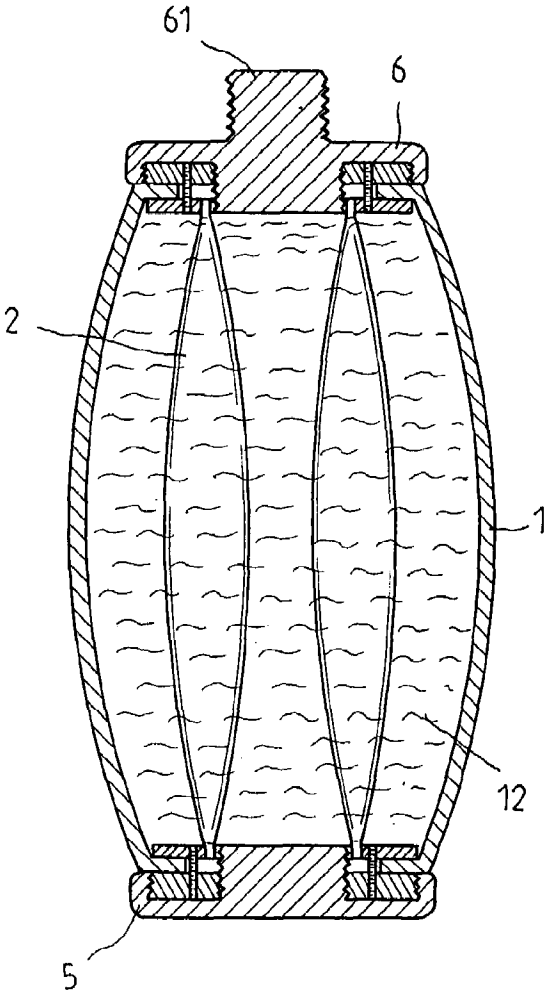
Figure 5:
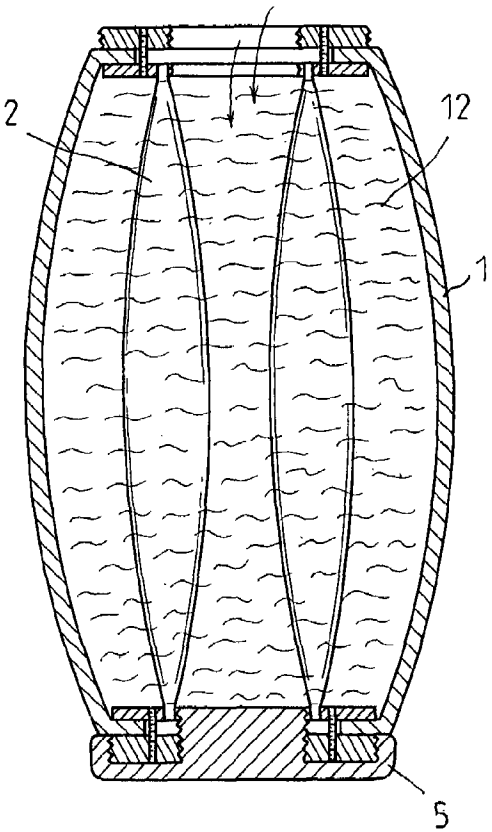

Further referring to FIGS. 5 and 6, the soft shell (1) has its inner space fulfill with sticky liquid (12), such as silicon glue. A top cap (6) is covered thereon to seal the handle, which will become a really soft handle.

Figure 10:
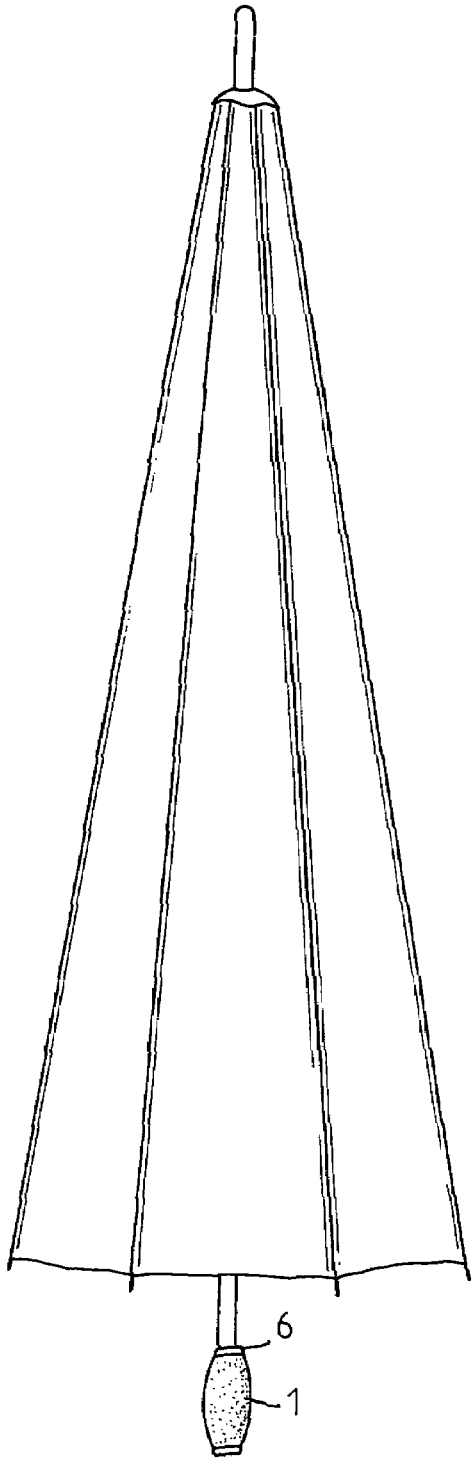
FIG. 10 is a plan view showing the soft handle applied on an umbrella.
Figure 11:
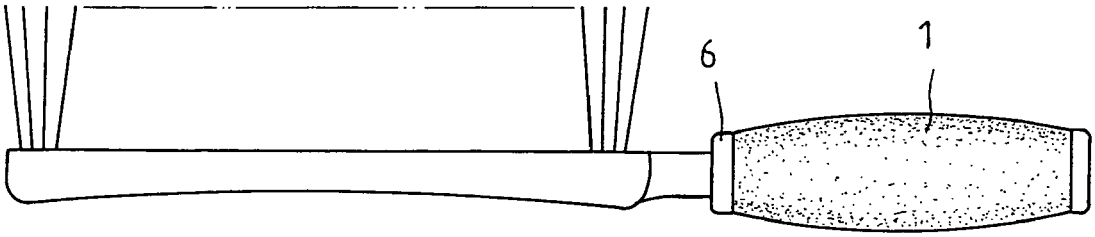
FIG. 11 is a plan view showing the soft handle applied on a comb.
Figure 12:
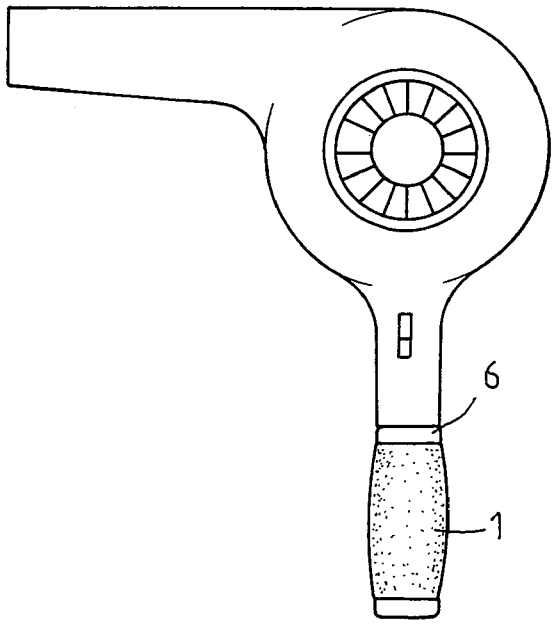
FIG. 12 is a plan view showing the soft handle applied on a hair drier.
Figure 13:
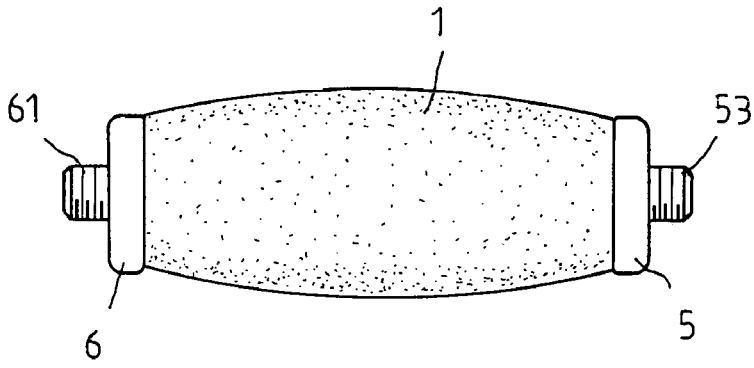
FIG. 13 is a plan view showing a modified structure of the soft handle according to the present invention.
Figure 14:
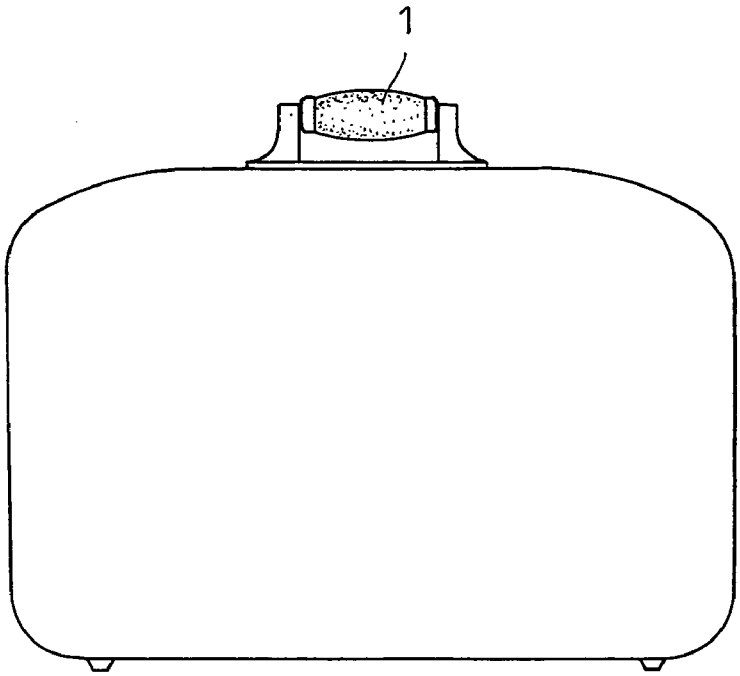
FIG. 14 is a plan view showing the soft handle applied on a brief case.
Figure 15:
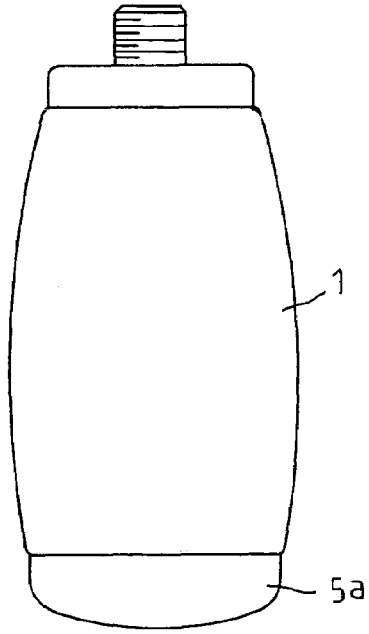
FIGS. 15 and 16 are plan views showing other modified structures of the soft handle according to the present invention.
Figure 16:
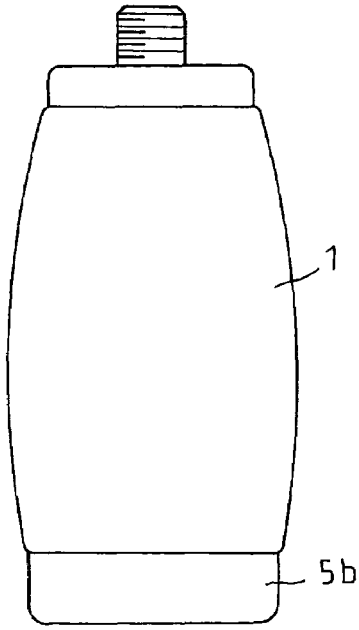

Under above assembly, the present invention can use a threaded rod (61) on the top cap (6) to connect with other products, such as shown in FIGS. 10 to 12, including an umbrella, a comb, or a hair drier. Since the shell (1) with inner sticky liquid (12) is very soft, the products with the handle of the present invention can be used comfortable even a long time use. In FIGS. 13 and 14, the handle of the present invention has threaded rods (53), (61) on both caps (5), (6) for applying on a brief case that will also be a utilized embodiment. Moreover, the bottom cap (5) can be modified to be a ball cap (5*a*) (FIG. 15), or a cylinder cap (5*b*) (FIG. 16) as desired.

Figure 7:
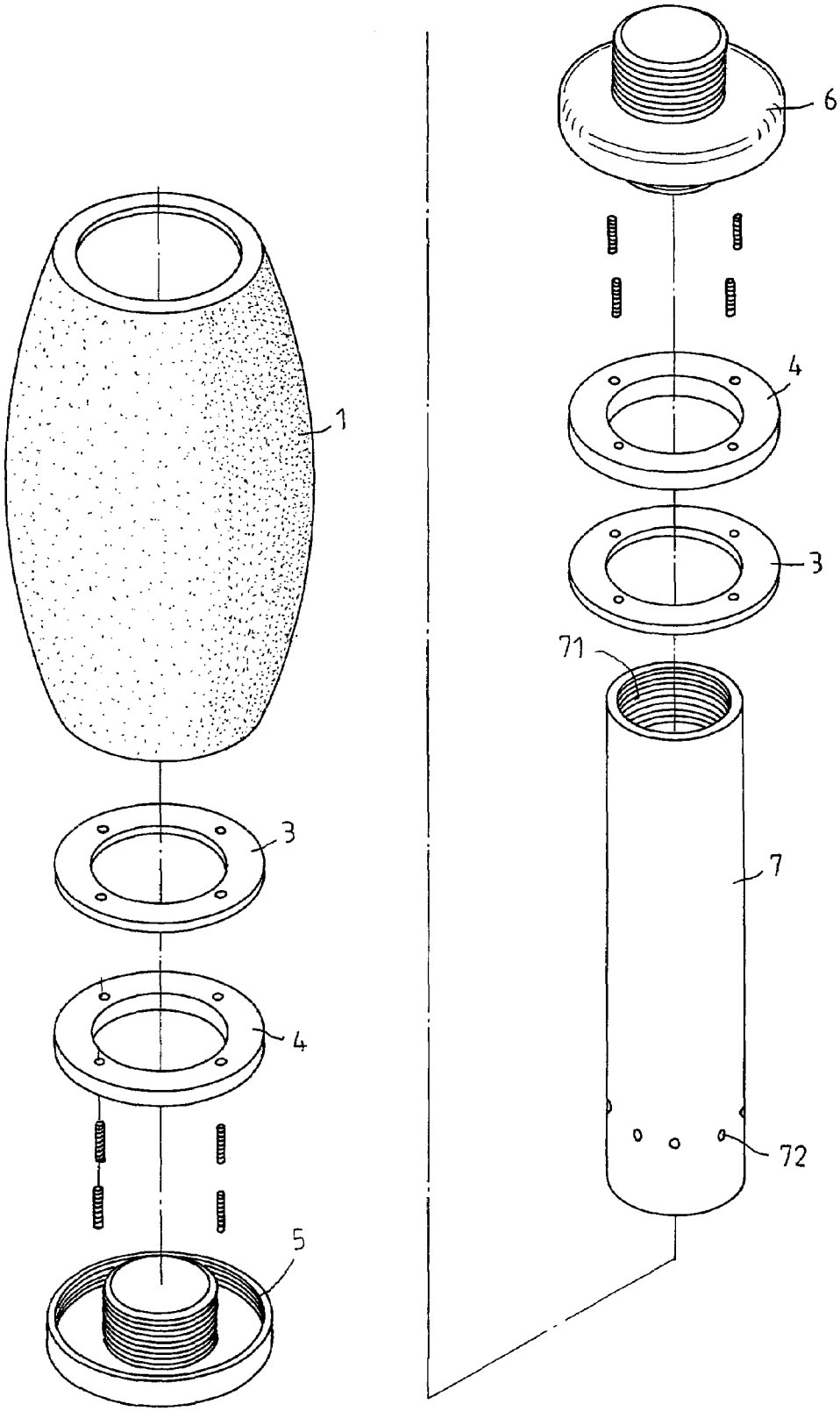
FIG. 7 is a perspective view showing another embodiment of a soft handle according to the present invention.
Figure 9:
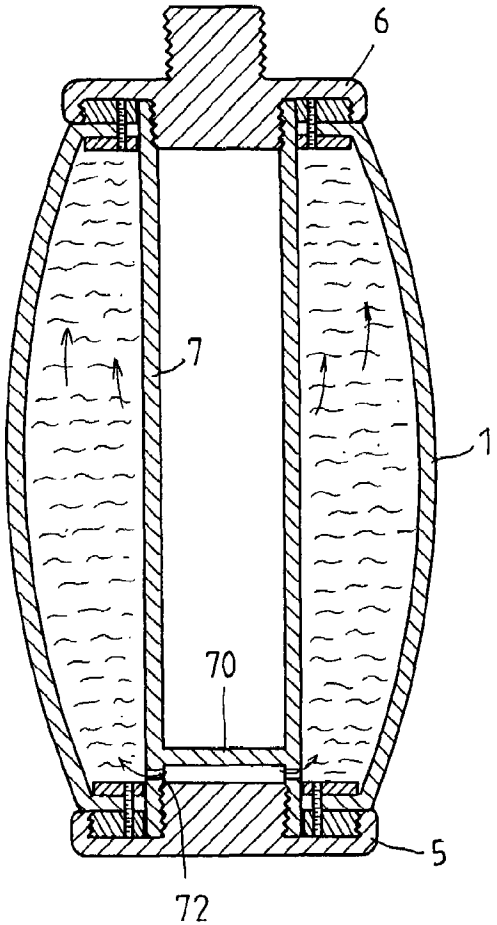
FIGS. 8 to 9 show the cross-sectional views of assembling procedures of FIG. 7.
Figure 8:
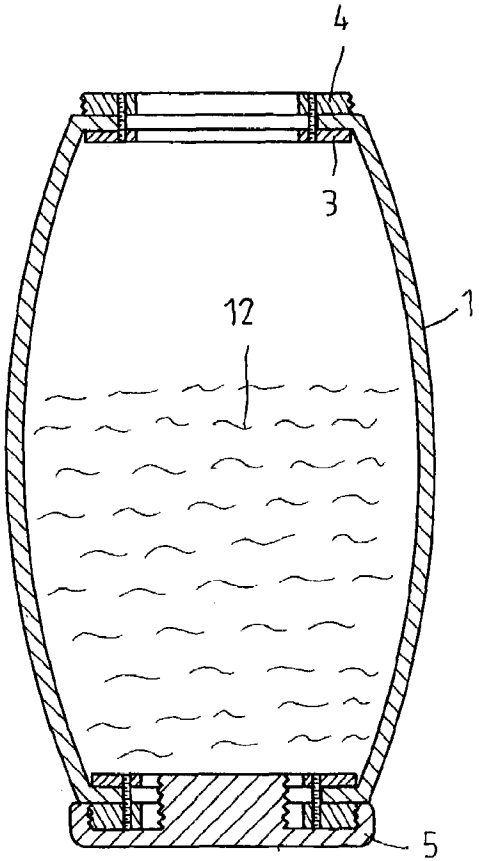

Now, please refer to FIGS. 7 to 9, the present invention is provided with a sleeve (7) to instead the supports (2) in previous embodiment. The sleeve (7) has top and bottom thread portions (71) to connect with top and bottom caps (5), (6). Beneath a bottom plate (70) of the sleeve (7), there are several apertures (72) for liquid (12) passing through as the sleeve (7) is put in the shell (1). The liquid (12) will be therefore fulfilled in the inner space of the shell (1) to provide a utilized soft handle.

In above description, they are only embodiments to illustrate our embodiment and are not to limit the scope of this application. Any modified embodiments with similar merits are also claimed according to the present invention.

I claim:

1. A soft handle including a soft hollow shell and a pair of supports, wherein the hollow shell having a flange on both top and bottom sides thereof, which are capable of being clipped by inner rings and outer rings, both of which are engaged by screws to become a single body, the inner rings having two inner opposite apertures and the outer rings having outer threads, while both inner and outer rings have inner threads, the two supports having top and bottom rods to engage with the related apertures of the inner rings to provide securement, a bottom cap connecting with a bottom side of the shell, wherein the bottom cap has a thread rod to connect with inner threads of the rings and having inner threads formed in its side flange to connect with outer threads of the outer rings, and the soft shell having its inner space filled with liquid and a top cap being covered thereon to seal the handle.

2. The soft handle as claimed in claim 1, wherein the top and bottom caps have outward threaded rods to connect with other products.

3. The soft handle as claimed in claim 1, wherein the bottom cap can be a ball cap or a cylinder cap.

* * * * *